US006174073B1

(12) United States Patent
Regan et al.

(10) Patent No.: US 6,174,073 B1
(45) Date of Patent: Jan. 16, 2001

(54) RADIO FREQUENCY REMOTE-CONTROLLABLE LIGHTING SYSTEM HAVING PLURALITY OF LIGHTING UNITS

(76) Inventors: Bernard Regan, 66 Onslow Gardens, Sanderstead, South Croydon, Surrey (GB), CR2 9AT; Paul V Griew, 99 St. Marks Road, Henley-on-Thames, Oxfordshire (GB), RG9 1LP ( * ) Notice: Under 35 U.S.C. 154(b), the term of this patent shall be extended for 0 days.

(21) Appl. No.: 09/091,947

(22) PCT Filed: Jan. 2, 1997

(86) PCT No.: PCT/GB97/00007

§ 371 Date: Jun. 26, 1998

§ 102(e) Date: Jun. 26, 1998

(87) PCT Pub. No.: WO97/24908

PCT Pub. Date: Jul. 10, 1997

(30) Foreign Application Priority Data

Jan. 2, 1996 (GB) ..... 9600004

(51) Int. Cl.[7] ..... F21V 23/04

(52) U.S. Cl. ..... 362/251; 362/394; 340/825.72; 340/825.69; 315/312; 315/318

(58) Field of Search ..... 362/394, 251, 362/85; 340/825.69, 825.72; 315/312, 317, 318

(56) References Cited

U.S. PATENT DOCUMENTS

| | | | | |
|---|---|---|---|---|
| 3,590,271 | * | 6/1971 | Peters | 307/140 |
| 4,242,614 | | 12/1980 | Vatis et al. | 315/153 |
| 4,355,309 | | 10/1982 | Hughey et al. | 340/825.53 |
| 4,523,128 | | 6/1985 | Stamm et al. | 315/291 |
| 4,590,471 | | 5/1986 | Pieroway et al. | 340/825.69 |
| 4,691,341 | | 9/1987 | Knoble et al. | 379/93.26 |
| 4,755,792 | * | 7/1988 | Pezzolo et al. | 340/538 |
| 4,843,386 | | 6/1989 | Wolf | 340/825.69 |
| 4,918,690 | | 4/1990 | Markkula, Jr. et al. | 370/400 |
| 5,059,871 | * | 10/1991 | Pearlman et al. | 315/316 |
| 5,109,222 | * | 4/1992 | Welty | 340/825.72 |
| 5,160,924 | | 11/1992 | Jean-Pierre et al. | 340/825.52 |
| 5,254,908 | * | 10/1993 | Alt et al. | 315/312 |
| 5,949,200 | * | 9/1999 | Ference et al. | 315/318 |
| 5,962,991 | * | 10/1999 | Levy | 315/312 |

FOREIGN PATENT DOCUMENTS

| | | |
|---|---|---|
| 2654240 | 5/1991 | (FR) . |
| 2174222 | 10/1986 | (GB) . |
| 2210187 | 6/1989 | (GB) . |
| 2280291 | 1/1995 | (GB) . |
| 2294569 | 5/1996 | (GB) . |
| WO 96 18983 | 6/1996 | (WO) . |

* cited by examiner

*Primary Examiner*—Alan Cariaso
*Assistant Examiner*—Ronald E. DelGizzi
(74) *Attorney, Agent, or Firm*—Nixon & Vanderhye P.C.

(57) ABSTRACT

A lighting system includes a plurality of lighting units each having an element capable of illumination and an associated switch unit which can respond to a radio frequency signal to connect the element to or disconnect the element from a source of electrical energy. A one or more remote control switch units are operable to transmit control signals to control operation of the lighting units, each remote control switch unit being arranged to transmit radio frequency signals which include an identification portion for identifying those lighting units which are to respond to the transmitted signals.

11 Claims, 2 Drawing Sheets

RADIO FREQUENCY REMOTE-CONTROLLABLE LIGHTING SYSTEM HAVING PLURALITY OF LIGHTING UNITS

BACKGROUND OF THE INVENTION

1. Field of the Invention

This invention relates to the control of lighting units and in particular to a system for controlling light units within a building.

2. Related Art

Lighting systems within buildings conventionally comprise a plurality of lighting units which are distributed throughout the various rooms of the building. The lighting units are connected by electrical wiring to the electrical mains to provide power for the lighting and also by other wiring to switches which enable the lighting units to be switched on and off as required. The switches are usually mounted on a wall and the wiring connecting the switch to the lighting unit is usually set into the wall. It is not uncommon for the layouts within the rooms of buildings to be changed periodically. This can result in the positions of the switches having to be changed and accordingly, new wiring has to be provided between the lighting units and the switches. As a consequence there is a need to repair the surface of the wall resulting from the damage which is inevitably caused in providing the new wiring and then subsequently redecorating the room. This can be a costly and time consuming exercise.

Furthermore hard wired switches severely limit the way in which a number of switches can be used to control lighting. If more than one switch is to control a light there must be a three way cable connection on all of the switches.

The present invention is concerned with a lighting unit control arrangement which does not require electrical wiring between the switch control and the lighting unit and therefore inter alia obviates the above-mentioned problems.

Techniques for the remote control of lights have been described in, for example, GB-A-2174282, EP-A-0255580, and GB-A-2280291. These arrangements are limited to control within a room and do not provide building wide control.

SUMMARY OF THE INVENTION

According to the present invention there is provided a lighting system comprising a plurality of lighting units each having an element capable of illumination and an associated switch unit which can respond to a radio frequency signal to connect the element to or disconnect the element from a source of electrical energy, and one or more remote control switch units which are operable to transmit control signals to control operation of the lighting units, the or each remote control switch unit being arranged to transmit radio frequency signals which include an identification portion to ensure only the correct lighting units are to respond to the transmitted signals.

Thus the link between each switch unit and an associated lighting unit is by means of radio communication. Each lighting unit can have a receiver and control circuit responsive to a received signal to operate a lighting unit switch. The use of radio communication enables the system to be used on a building wide basis so that a switch unit in one room can be used to control lighting units in another room or rooms.

Each remote control switch unit may be arranged to transmit a signal which comprises an identification portion and an instruction portion. The transmitter of each remote control switch unit may be arranged to transmit a control signal a predetermined number of times. The intervals at which the control signals are transmitted may be regular or random. The identification portion of the control signal should have sufficient capacity to provide for the required number of lighting unit combinations.

BRIEF DESCRIPTION OF THE DRAWINGS

The invention will be described now by way of example only, with particular reference to the accompanying drawings. In the drawings.

DETAILED DESCRIPTION OF EXEMPLARY EMBODIMENTS

Figure 1:
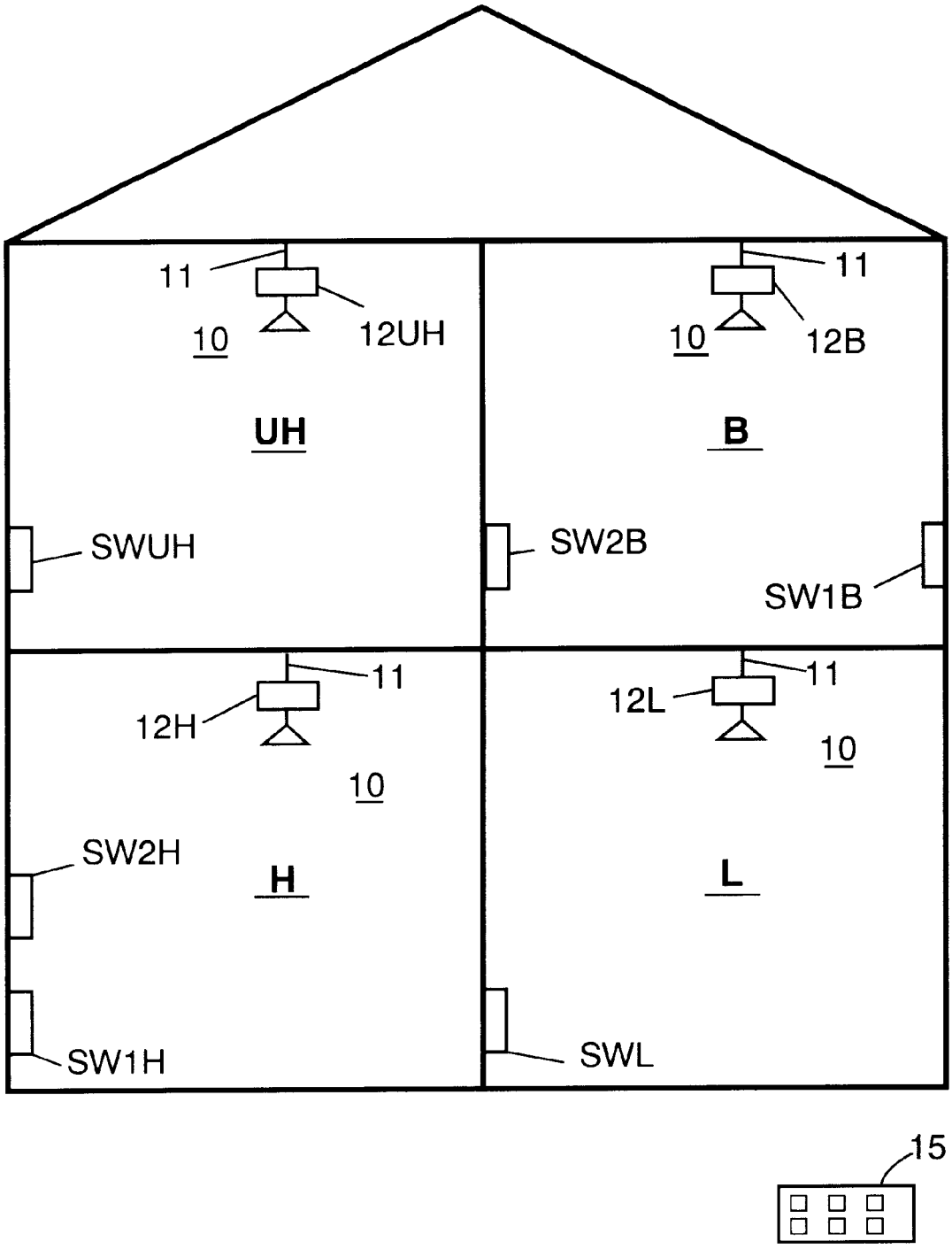
FIG. 1 is a schematic illustration of a lighting control system in accordance with the present invention.

Referring to FIG. 1, there is shown a lighting system within a building which as illustrated comprises an entrance hall (H), a living room (L), an upstairs hall (UH) and a bedroom (B). This configuration is merely for illustration and it will be appreciated that a lighting system in accordance with the present invention can be used in an extremely wide range of buildings. The lighting system comprises a plurality of lighting units shown generally at (10). The illustration shows one lighting unit per room but the system can operate with more than one unit per room and with different numbers of units in each room. Each lighting unit is connected by electrical wiring (11) to the main power supply. Also each lighting unit has associated control circuitry (12H), (12L), (12UH), and (12B), which can receive remotely transmitted radio signals and in response to those signals either connect the lighting unit to the main supply or disconnect it from that supply. The radio signals are transmitted from remote switch units which are shown at SW1H, SW2H, SWUH, SW1B, SW2B, SWL. Each switch unit can transmit a radio signal to a lighting unit or units and thereby either switch on the lighting unit or switch off the lighting unit.

In the present system the lighting units within any particular room can be controlled from any selected ones of the switches SW1H, SW2H, SWUH, SW1B, SW2B, SWL. This is made possible by the use of coded messages transmitted as radio frequency signals as the means of communication between the switches and control circuitry 12. The particular scheme employed will depend on the requirements for the building concerned. It is possible, for example, to have all lighting units controllable from all switches, one switch to control all lighting units or the lighting unit within a particular room controllable only from switches in that room, or any combination between those extremes.

In the example illustrated in FIG. 1 the arrangement is as follows.

Switches SW1H and SWUH can be used to turn on and off the lighting units in the entrance hall (H) and the upper hall (UH).

Switch SW2H can be used to turn off all lighting units in the building, e.g. when the last person leaves.

Switch SWL can turn on and off and also dim the lighting unit in the living room (L).

Switches SW1B and SW2B can be used to turn on and off and also dim the lighting unit in the bedroom (B). Alternatively the switch SW2B could be detached from its wall mounting and used from the bed.

The system can include a hand held controller (15) which can be programmed to control any lighting unit or combination of lighting units. The hand held unit can be arranged to transmit the same coded message as the switches or a different message unique to the hand held unit. Thus all lighting units can respond to the hand held unit and that unit can be used to create a wide range of different lighting effects.

It is believed to be a novel concept to provide such a lighting system for a building wherein there is a radio frequency link between the switch control units and the lighting units to control the switching on and switching off of the lighting units. The use of radio frequency allows wireless communication between a switch control unit or units and lighting units over the entire building.

Figure 2:
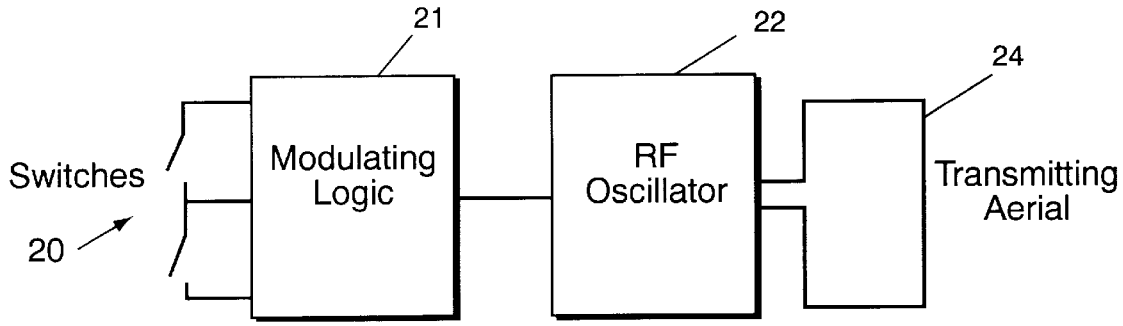
FIG. 2 is a block schematic diagram showing a remote control switch unit which is used in the system of FIG. 1.

Each remote control switch unit (SW) may be portable or may be wall-mountable. FIG. 2 shows in block schematic form the basic components of such a control unit. The control unit comprises one or more switches (20) which are linked to modulating logic (21). The modulating logic (21) controls an RF oscillator (22) which can provide a radio control signal by way of a transmitting aerial (24). Each switch unit is a self-contained unit and can be powered by a battery of long life, say 5 to 10 years. An alternative arrangement would be to keep the battery charged using an electromagnetic field or photoelectric cells.

Each switch unit can be provided with conventional single throw switches, or other types of switches could be incorporated such as rotary controls which enable the lighting units to be dimmed. Other units are possible which contain a plurality of switches. A typical arrangement will be one in which there is a center biased double throw switch (20) which can be used both for on off control and also for dimming. This arrangement results in the integration of more than one dimming control for the same lighting unit being greatly simplified.

To maintain battery life the switch or switches (20) of each control unit should have a very low quiescent current until the switch is operated. This is easily achievable with a center biased switch, but other types of switches may need some additional circuitry. For example the state of the switch could be sampled for a short time at regular intervals or, in the case of a single throw switch, the circuit could be configured so that current will only be taken when the switch is next operated. These techniques are within the competence of those skilled in the art.

The signal transmitted by the aerial (24) will be a modulated signal and will contain an identification portion and an instruction portion. The identification portion can either relate to the switch or to the lighting unit and this information will have been programmed into the various elements of the system. The purpose of the identification portion is to ensure that only the intended lighting units are operated and not, for example, a lighting unit in an adjoining building. The instruction set can include options such as lighting on, lighting off, intensity up or intensity down. More complex instructions such as return to stored level or set to stored level are also possible where these have been pre-programmed into the processing facility of the system control.

In the arrangement shown in FIG. 1 switch SW1H transmits code AAA, switch SW2H transmits code BBB, switch SWUH transmits code CCC, switch SW1B transmits code YYY, switch SW2B transmits code ZZZ, and switch SWL transmits code XXX. Lighting unit controls 12H and 12UH can respond to codes BBB, YYY, ZZZ, i.e. switches SW1B, SW2B and SW2H and lighting unit control 12L can respond to codes BBB, XXX, i.e. switches SWL and SW2H. The letters AAA, etc. represent the identification part of the code and are illustrative only and not intended to represent actual codes. The identification part will be followed by an instruction part.

The preferred arrangement is for each switch unit to have a unique, randomly coded number, and for each lighting unit control circuitry to be programmed with the identity of those switch units to which it is to respond.

Figure 3:
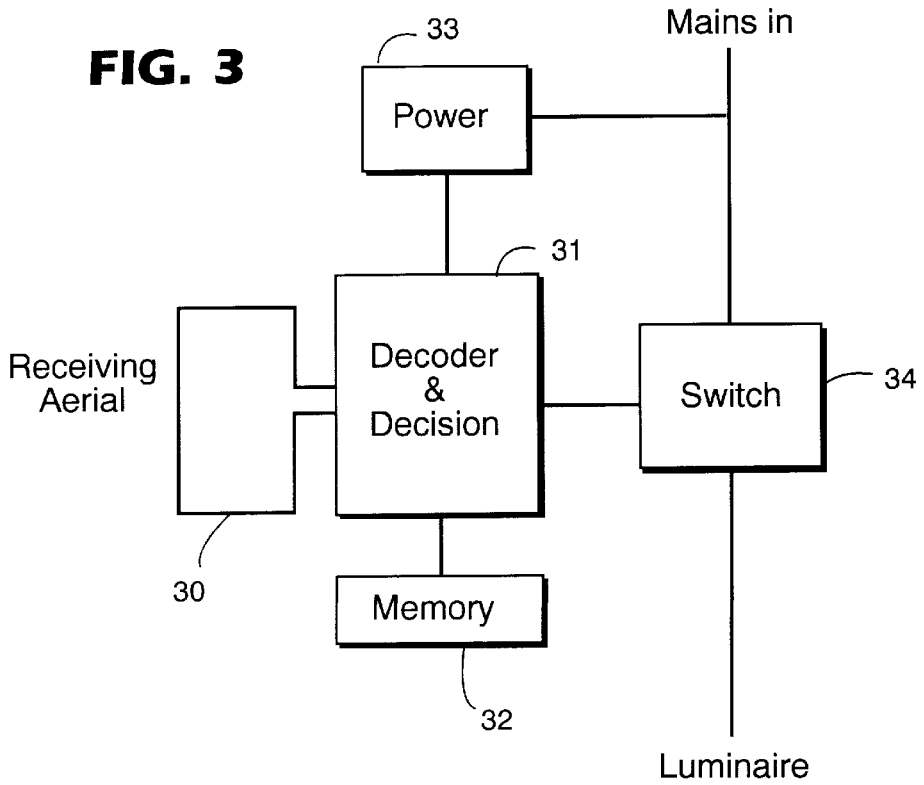
FIG. 3 is a block schematic diagram illustrating the control circuitry of each lighting unit of the lighting system.

FIG. 3 shows a block diagram of the circuitry (12) associated with each lighting unit. The circuit includes a receiving aerial (30) for receiving the radio signal transmitted from a remote control unit, a decoder and decision circuit (31), a memory (32), a power circuit (33) which provides power to the decoder and decision circuit (31) and a switch (34) which can be operated to connect the electrical mains to the light element of the lighting unit.

The decoder and decision circuit (31) will normally contain a radio receiver circuit and a microprocessor (or equivalent custom integrated circuit). The memory (32) can be an EEPROM or other non-volatile memory. The switch 34 will normally be a thyristor or triac semiconductor device.

The reliability of the system is enhanced by arranging that the transmissions from each switch control unit (14) are repeated at pseudo-random intervals in order to avoid problems when two switches are used substantially simultaneously. The number of repeats can be programmed into each control unit and the selected number will be a compromise taking into account battery life and reliability. Also the total time taken by the repeated transmissions should not be too long, or the user will find the apparent delay unacceptable. Reliability can also be improved by scrambling the transmission, so that the transmission differ. During a set of repeated transmissions a number of different versions of the data are sent. A lighting unit will only respond if it receives two transmissions containing the same data but scrambled in different ways. This feature can eliminate nuisance operation either from external coherent noise, which might mimic a real transmission or even from a person who might wish to disrupt the lighting in someone else's premises.

In the preferred method, the pre-programmed identity number within each switch control unit will have at least 20 bits allowing 1 million different identities, plus two additional bits which can be selected at installation to cover the extremely unlikely event that there are two switch control units with the same identity. Altering either of these two bits will allow the two units to be differentiated. It is preferred that the transmissions are scrambled using 4 different encoding keys to give 4 different scrambled versions, so that each operation of the switch unit causes a total of 8 transmissions, with each of the 4 possible scrambled versions being sent twice. The lighting unit will then only respond to a transmission if it receives two of the eight transmissions and these have different forms of scrambling.

Lighting units are programmed by putting them into a programming mode. This can be done in one or two ways, either by operating a switch on the lighting unit, or by using a special programming unit. Then all switch units that are to control that particular lighting unit are sequentially (and separately) turned on, and held for a significant time to avoid false programming. If a switch unit is no longer required to operate that lighting unit it is turned to off. Finally the lighting unit is taken out of programming mode. A special programming unit has the advantage that it is easier to implement more complex programming tasks, such as inverted operation where a light will come on when a switch is turned off.

It will be appreciated that this programming technique allows any switch unit to control any lighting unit. Different modes of control are possible by altering the transmission from a switch unit, so that it can be set to transmit commands related to dimming control, or the lighting unit can be programmed to respond to different switch units in different ways.

An example of a simple program for generating code transmission is to be found at the end of this description.

The remote control switch unit will normally look like a normal wall mounted light switch, but it can be designed as a hand held portable unit, possibly similar in appearance to that used for remote controlling a TV. This will enable users to control lights within a room from their seat. In the present case, the signals from each remote control unit will be transmitted directly to the lighting unit, thereby removing the need for any wiring between the switch and the lighting unit. This enables arrangements within a room to be changed without there being the consequent need for movement of switches and associated wiring. It is also possible to produce portable remote control switch units, which can be attached to walls in a special bracket. This would allow users to move a switch to the most convenient location.

In this mode it can transmit special programming commands to the lighting units. It will be appreciated that a hand-held unit can be used as the means of programming a lighting system.

It is possible to provide a system in which there is a central control unit which receives signals from the remote control units and transmits the control signals to the various lighting units. Such a facility is envisaged in a large building and there may need to be repeater transmitters where substantial distances are involved.

The provision of a programmable control unit enables a user to change the way in which the lighting units within the building are controlled in an easy and simple manner.

A brief summary of pseudo-code demonstrating how transmissions may be generated follows:

```
{First set up transmissions, which says how many times data
  is yet to be sent}
if (Switch_Off)
then begin
  transmissions:=8; {there will be 8 transmissions of basic
    data}
  Switch_State:=0; {switch is off, for which code is 0}
  end;
if (Switch_On)
then begin
  transmissions:=8;
  Switch_State:=1; {switch is on, for which code is 1}
  end;
key=0;
if (transmissions>0) then repeat {something to send}
  Increment(key); {key counts round from 0 to 3 continu-
    ously}
  if (key>3) then key:=0;
  end;
  instr:=Switch_State: {instruction}
  key2:=key*31;
  A:=key2 xor instr;
  A:=A*4+key; {key itself is transmitted unmodified in first
    byte to simplify decode}
    {first byte, A, is key plus instruction. All except key is
      scrambled}
  Transmit(A);
  B:=Scramble (ID[0],key2,A);
  Transmit(B);
  C:=Scramble(ID[1],key2,B);
  Transmit(C);
  D:=Scramble(ID[2],key2,C);
  Transmit(D);
  Wait_Delay:=Random_Delay(Wait_Delay,A,B,C,D);
  Delay(Wait_Delay); {times 100 μs}
  if (transmissions>0) then Decrement(transmissions);
    {count down number of transmissions to send}
until (transmissions=0); when nothing to send}
```

What is claimed is:

1. A lighting system for a building comprising:

a plurality of lighting units each having an element capable of illumination and an associated control unit which can respond to a radio frequency signal to connect the element to or disconnect the element from a source of electrical energy, said lighting units being located in a number of different locations in the building and a plurality of remote control switch units which are arranged at a number of different locations in the building and operable to transmit control signals to control operation of the lighting units, each remote control switch unit being arranged to transmit radio frequency signals for controlling operation of at least one lighting unit, wherein each remote control switch unit is arranged to transmit a radio frequency signal which includes an identification portion indicative of the remote control switch unit which transmits the signal, and each control unit is located in the vicinity of the associated element capable of illumination and is programmable so that the control unit can be set to respond to the identification portion transmitted from any one or more of the remote control switch units .

2. A lighting system as in claim 1 wherein the transmitted signal which includes said identification portion also includes an instruction portion.

3. A lighting system as in claim 1 wherein the transmitted signal including said identification portion is repeated several times with a gap in time between each transmission.

4. A lighting system as in claim 3, wherein the gaps in time are substantially equal.

5. A lighting system as in claim 3, wherein the gaps in time are substantially non-equal.

6. A lighting system as in claim 1 wherein the transmitted radio frequency signals transmitted from each remote control switch unit are scrambled using different scrambling keys, and each lighting unit is arranged to be operated only if the lighting unit receives plural transmissions relating to a switch unit to which it is set to respond.

7. A lighting system as in claim 1, wherein each remote control switch unit has a programming mode and is programmable by receiving transmitted radio frequency signals.

8. A lighting control system for use in the rooms of a building, said lighting system comprising:

plural lighting units disposed at respective locations within said building;

each lighting unit including a radio frequency receiver, digital decoder and decision unit connected to control an associated lighting unit switch in response to receipt of a radio frequency signal having at least one predetermined multi-digit control code; and plural remote control switch units also disposed at respective locations within said building;

each of said remote control switch units including a radio frequency transmitter having modulating and logic circuits for transmitting a radio frequency signal having at least one predetermined multi-digit control signal;

wherein one of said lighting units may be caused to respond to a predetermined set of said remote control switch units and one of said remote control switch units may be caused to control a predetermined set of said lighting units;

said remote control switch units transmit plural different assigned control codes; and said lighting units only respond to receipt of at least two different assigned control codes.

9. A lighting control system for use in the rooms of a building, said lighting system comprising:

plural lighting units disposed at respective locations within said building;

each lighting unit including a radio frequency receiver, digital decoder and decision unit connected to control an associated lighting unit switch in response to receipt of a radio frequency signal having at least one predetermined multi-digit control code; and plural remote control switch units also disposed at respective locations within said building;

each of said remote control switch units including a radio frequency transmitter having modulating and logic circuits for transmitting a radio frequency signal having at least one predetermined multi-digit control signal;

wherein one of said lighting units may be caused to respond to a predetermined set of said remote control switch units and one of said remote control switch units may be caused to control a predetermined set of said lighting units;

said remote control switch units transmit an assigned code plural times; and said lighting units only respond to receipt of an assigned control code at least two times.

10. A method for effecting lighting in the rooms of a building, said method comprising:

disposing plural lighting units at respective locations within said building;

providing each lighting unit with a radio frequency receiver, digital decoder and decision unit connected to control an associated lighting unit switch in response to receipt of a radio frequency signal having at least one predetermined multi-digit control code;

also disposing plural remote control switch units at respective locations within said building; and providing each of said remote control switch units with a radio frequency transmitter having modulating and logic circuits for transmitting a radio frequency signal having at least one predetermined multi-digit control signal;

wherein one of said lighting units may be caused to respond to a predetermined set of said remote control switch units and one of said remote control switch units may be caused to control a predetermined set of said lighting units; and said remote control switch units transmit plural different assigned control codes; and said lighting units only respond to receipt of at least two different assigned control codes.

11. A method for effecting lighting in the rooms of a building, said method comprising:

disposing plural lighting units at respective locations within said building;

providing each lighting unit with a radio frequency receiver, digital decoder and decision unit connected to control an associated lighting unit switch in response to receipt of a radio frequency signal having at least one predetermined multi-digit control code;

also disposing plural remote control switch units at respective locations within said building; and providing each of said remote control switch units with a radio frequency transmitter having modulating and logic circuits for transmitting a radio frequency signal having at least one predetermined multi-digit control signal;

wherein one of said lighting units may be caused to respond to a predetermined set of said remote control switch units and one of said remote control switch units may be caused to control a predetermined set of said lighting units; and said remote control switch units transmit an assigned code plural times; and said lighting units only respond to receipt of an assigned control code at least two times.

* * * * *